US005316095A

United States Patent [19]

Tibbitts

[11] Patent Number: 5,316,095

[45] Date of Patent: May 31, 1994

[54] DRILL BIT CUTTING ELEMENT WITH COOLING CHANNELS

[75] Inventor: Gordon A. Tibbitts, Salt Lake City, Utah

[73] Assignee: Baker Hughes Incorporated, Houston, Tex.

[21] Appl. No.: 910,719

[22] Filed: Jul. 7, 1992

[51] Int. Cl.[5] ..... E21B 10/18

[52] U.S. Cl. ..... 175/429; 175/434

[58] Field of Search ..... 175/429, 434, 417, 418, 175/419; 76/108.2, 108.4

[56] References Cited

U.S. PATENT DOCUMENTS

| | | | |
|---|---|---|---|
| 4,303,136 | 12/1981 | Ball . | |
| 4,452,324 | 6/1984 | Jurgens . | |
| 4,606,418 | 8/1986 | Thompson | 175/429 |
| 4,852,671 | 8/1989 | Southland . | |
| 4,902,073 | 2/1990 | Tomlinson et al. | 175/429 X |
| 4,913,244 | 4/1990 | Trujillo . | |
| 4,913,247 | 4/1990 | Jones . | |
| 5,027,912 | 7/1991 | Juergens | 175/429 X |
| 5,028,177 | 7/1991 | Meskin et al. . | |

FOREIGN PATENT DOCUMENTS

| | | |
|---|---|---|
| 0239328 | 9/1987 | European Pat. Off. . |
| 0317069A1 | 10/1988 | European Pat. Off. . |

OTHER PUBLICATIONS

U.K. Search Report-dated Sep. 16 1993.

*Primary Examiner*—William P. Neuder
*Attorney, Agent, or Firm*—Trask, Britt & Rossa

[57] ABSTRACT

A diamond cutting element for use on an earth boring drill bit, such as a drag bit. The cutting element is cooled with drilling fluid via a plurality of internal channels having outlets adjacent the peripheral cutting edge of the diamond cutting element.

31 Claims, 3 Drawing Sheets

DRILL BIT CUTTING ELEMENT WITH COOLING CHANNELS

BACKGROUND OF THE INVENTION

1. Field of the Invention

This invention relates generally to diamond cutting elements employed in drag bits for drilling subterranean formations, and more specifically for a structure and method for cooling the diamond tables of such cutting elements and their associated substrates.

2. State of the Art

Diamond cutting elements have been employed in earth boring drill bits for many decades. During the last twenty years, synthetic diamonds, known as polycrystalline diamond compacts, or PDC's, have been made available on the market by General Electric, DeBeers and others. These PDC's are available in a variety of shapes, but one preferred configuration widely employed in earth boring drill bits is a planar disc, variations of which, including half-discs and "tombstone" shaped planar cutters, have also been employed Non-planar diamond cutting elements have also been developed and proposed, such as "dome" cutters and concave cutters. Advances in diamond film technology enhance the feasibility of non-planar cutters of fairly complex configuration.

Planar PDC cutting elements generally comprise an assembly of a layer of diamond crystals bonded together under ultra-high temperature and pressure into a wafer-like, thin layer or "diamond table" on a cemented carbide (such as WC) substrate of similar configurations. The PDC cutting element is then bonded via the substrate (as by brazing) to a carrier element such as a stud, cylinder or other supporting structure, which in turn is secured to the face of the drill bit. It will be appreciated that some PDC cutting elements may not possess a uniform thickness diamond table and, as with overall cutter configuration, diamond film technology presents many potential options for varying diamond table thickness.

PDC's have been a great success in advancing the state of the drill bit art, and are now widely employed in drill bits of numerous and diverse configurations. Since the early days of PDC use on drill bits, however, it has been apparent that PDC's suffer thermal degradation at the high temperatures generated by the frictional abrasive contact of the PDC cutting edge with the formation as the bit rotates and weight is applied to the drill string on which the bit is mounted. Such degradation leads to premature dulling of the PDC cutting edge, and even gross failure of the PDC cutting element assembly. Improved feed stock and fabrication techniques have raised the thermal tolerance of PDC's to some degree, and there has developed a subcategory of PDC's known as thermally stable products, or TSP's, which retain their physical integrity to temperatures approaching 1000° C. TSP's may be infiltrated into matrix body drill bits at the time of bit furnacing, rather than being attached at a later time, as with non-thermally stable PDC's. However, even TSP's suffer from thermal degradation during cutting of the formation as the drill bit advances the well bore.

While the prior art has focused on problems associated with the degradation of the diamond layer or table, heating of the cutting element substrate (typically tungsten carbide) from the drilling operation is also detrimental to cutting element performance. Heat checking of the substrate, typically caused by alternative heating and quenching of the cutting elements as the drill bit bounces on the bottom of the borehole, can initiate more severe substrate cracking which, in turn, can propagate cracking of the diamond table.

A variety of attempts have been made to cool and clean PDC cutting elements during the drill operation by flushing the cutting elements with drilling fluid, or "mud," pumped down the drill string and through nozzles or other orifices on the face of the bit. The flow of drilling mud removes formation cuttings and other debris from the face of the bit and generally radially outwardly to the bit gage, up the junk slots and into the well bore annulus between the drill string and the wall of the well bore to the surface, where the debris is removed, the mud reconditioned with additives and again pumped down the drill string. It is known in the art to direct drilling mud flow across the face of a series of cutting elements (U.S. Pat. No. 4,452,324 to Jürgens); to direct mud flow from a nozzle toward the face of a single cutting element (U.S. Pat. No. 4,303,136 to Ball); and to direct flow from a nozzle to a single cutting element at a specific orientation (U.S. Pat. No. 4,913,244 to Trujillo). It has also been proposed to direct mud flow through the face of a PDC cutting element from internal passage extending from the interior of the drill bit through the carrier element and out an aperture in the face of the cutting element (U.S. Pat. No. 4,606,418 to Thompson). All of the foregoing approaches, while providing some cooling to the PDC cutting element, are believed to serve primarily to remove formation cuttings from the cutting elements, and only incidentally or secondarily to provide any benefit in cooling the cutting element, as the mud flow is actually quite removed from the high temperature point or line of contact between the outermost edge of the PDC cutting element (taken from the bit face) and the uncut formation. Stated another way, the intervening presence of the formation cuttings or chips being sheared from the formation at the PDC cutting edge prevents contact between the drilling mud flow and the high temperature interface between the cutting element and the formation in the vicinity of the cutting edge.

It has been proposed, in U.S. Pat. No. 4,852,671 to Southland, to direct drilling mud flow through a passage in a stud supporting a PDC to a relief between the pair of cutting points in the formation-contacting zone of a disc-shaped PDC cutting element to improve the cooling and cleaning of the cutting elements. While potentially an improvement over the previously-referenced externally-disposed drilling mud flow direction techniques, the Southland patent suffers from the limitations imposed by the use of a single fluid exit point proximate the cutting contact point of the PDC. Moreover, flow characteristics of the Southland cutter will commence an almost immediate deterioration as soon as drilling commences, it being generally known that unused planar PDC's, even those with so-called "chisel" configurations, or those of the Southland "double point" configuration, wear rapidly during the first part of a drilling operation. Thus, after a few dozen feet of drilling, the Southland cutter points are worn flat to the depth of the relief, and the fluid intended to flush and cool the cutting zone is ejected from the stud passage behind the cutting element, to no advantageous effect.

SUMMARY OF THE INVENTION

In contrast to the prior art, the structure and method of the present invention provides greatly enhanced cooling for cutting element diamond tables, their backings, and in particular for PDC cutting elements.

The structure of the present invention comprises at least one and preferably a plurality of laterally adjacent cooling channels or slots extending along the boundary between a layer of diamond material on the cutting face of the PDC cutting element and the supporting substrate and peripherally exiting the cutting element proximate the line of contact or contact zone between the cutting element and the formation. The cooling channels or slots are provided with a flow of drilling mud from a passage in a stud, cylinder or other carrier element by which the PDC cutting element is secured to the bit face, or directly from a passage in the bit body leading to an internal plenum or other fluid reservoir structure in fluid communication with the drill string. As the PDC cutting element wears from an initial, arcuate cutting edge to a "wear flat" or substantially linear cutting edge, the outlets of the cooling channels or slots remain in intimate proximity to the contact zone throughout the drilling operation. Thus, the cutting structure of the present invention provides an uninterrupted flow of cooling fluid to the entire contact zone until the drill bit is tripped out of the well bore.

The cooling channels or slots may be formed in the diamond material of the cutting elements, in the substrate material, or partially in each along the boundary therebetween. The substrate material may be machined, while the diamond material may be etched or electrodischarge machined (EDM). Fluid may be provided to the channels or slots individually, or from a central feed point via a manifold arrangement. The channel or slot arrangement may include an additional branch or branches to provide fluid flow for formation cutting removal from the face of the cutting element, flushing of such debris from under the cutter results in reduced cutter abrasion as well as reduced temperature increase due to such abrasion. The structure may also include a carrier element having not only a feed passage for the channels or slots, but also a flushing orifice directed toward other cutting structures on the face of the drill bit.

The method of the present invention, as practiced in association with the above-described structure, may generally be described as cutting a formation with a diamond cutting element while providing some portion of the drill string flow of cooling fluid to the line of contact or contact zone between the cutting element and the formation.

It will be recognized by those skilled in the art that the present invention may be applied to multi-element cutting structures such as is disclosed in U.S. Pat. No. 5,028,177, assigned to the assignee of the present invention, incorporated herein by this reference, and marketed as MOSAIC TM cutters, and to large, multi-element blade-type cutting structures such as are disclosed in U.S. Pat. No. 4,913,247 to Jones, also assigned to the assignee of the present invention and incorporated herein by this reference. Furthermore, the present invention is not limited to diamond cutters commercially available on the market, but may also be easily adapted to cutting elements comprising a diamond film, and in fact may be especially suited for use with same due to the ease with which slots and channels may be formed in the film or by which a slotted or grooved substrate may be masked in the grooves and a diamond film applied thereover. Finally, it will be appreciated that the present invention is equally applicable to planar and cross-planar diamond cutting elements of both uniform and non-uniform thickness or depth.

DETAILED DESCRIPTION OF THE PREFERRED EMBODIMENTS

Figure 1:
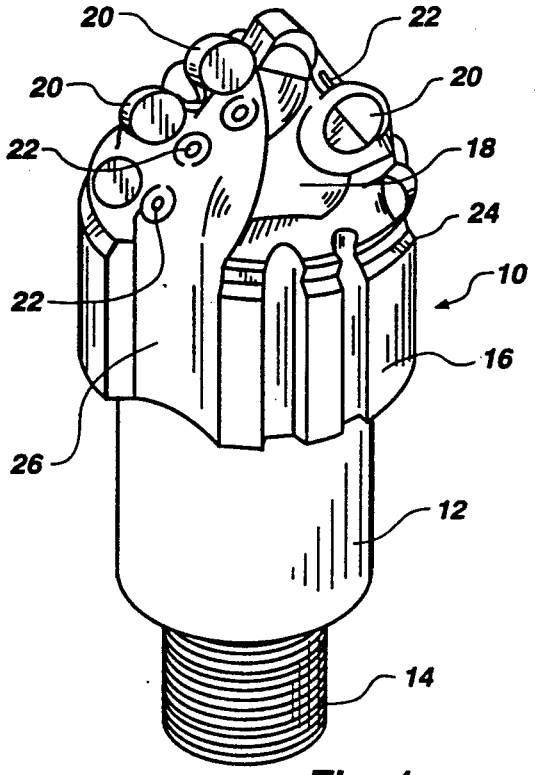
FIG. 1 is a perspective view of a drill bit employing cutting elements in accordance with the present invention.

Referring now to FIG. 1 of the drawings, earth boring drill bit 10 is depicted in perspective. Drill bit 10 is exemplary, and not limiting, of the type of drill bit which may be employed with and incorporate the present invention, and includes a bit shank 12 having a pin end 14 for threaded connection to a drill string, as well as a body 16 having a face 18 on which diamond cutting elements 20 according to the present invention may be secured. Bit 10 also includes a plurality of nozzles 22 for directing drilling mud to the bit face 18 for removal of formation cuttings to the bit gage 24, through junk slots 26 and upwardly to the surface past shank 12 and the drill string (not shown) in the well bore annulus to the surface.

Figure 1A:
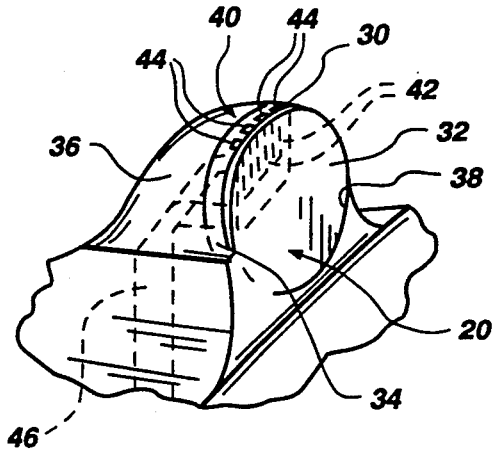
FIG. 1A is an enlarged perspective view of a first preferred embodiment of a cutting element according to the present invention mounted on the face of the bit of FIG. 1.

As can readily be seen from FIG. 1A, each cutting element 20 comprises a PDC cutting element including a substantially planar diamond layer or table 30 having a front face 32 and a rear face (not shown) bonded to a disc-shaped substrate 34 of similar configuration. Front face 32 is oriented to face generally in the direction of bit rotation. Substrate 34 is maintained on the face 18 of the bit 10 by brazing to the bit body 16 or to a carrier element secured thereto, or by direct bonding (in the case of a TSP) during formation of the body by furnacing of the bit. Cutting element 20 is supported from the rear against impact by protrusion 36 on the bit face 18, which, as shown, defines a socket or pocket 38 in which cutting element is cradled. Alternatively, cutting element 20 may be mounted on a cylindrical or stud-type carrier element, the latter type being press-fit or mechanically secured to the bit body, while both cylinders and studs may be braced therein.

As shown in FIG. 1A, cutting elements 20 include peripheral cutting edges or formation contact zones 40 which engage the subterranean formation as the drill bit 10 is rotated and weight (or force, in the case of horizontal drilling) is applied to the drill string. Cutting elements 20 each include a plurality of cooling channels or slots 42 (shown in broke lines) having outlets 44 along the cutting edge or contact zone 40. Cooling channels or slots 42 are provided with drilling fluid to cool the cutting elements 20, and specifically the cutting edges or contact zones 40 thereof, where frictionally-generated heat is greatest, to prevent or reduce thermal degradation of the diamond. Cooling channels or slots 42 receive drilling fluid from passage 46, which in turn receives same from an internal plenum (not shown) in drill bit 10.

While channels or slots 42 are referenced for convenience as "cooling" channels, their function is not so limited, and it should be noted that flow from ports 44 removes formation cuttings and other debris from the contact zone 40, and reduces the coefficient of friction between the cutting element and the formation, thus reducing frictional heating.

Figure 1B:
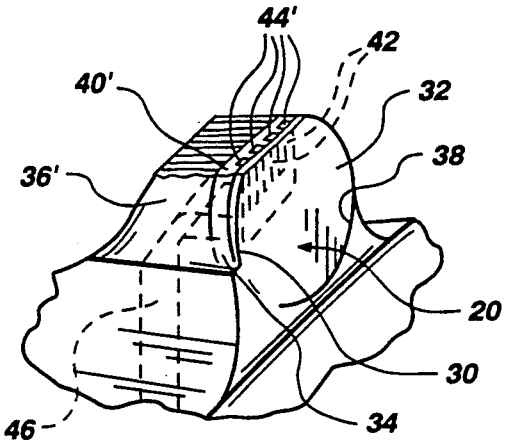
FIG. 1B is an enlarged perspective view of the cutting element of FIG. 1A after use in drilling a bore hole.

FIG. 1B depicts a cutting element 20 after substantial wear has taken place during the drilling operation. Cutting edge or contact zone 40 has now developed into a substantially linear wear flat 40', and supporting protrusion 36 has likewise worn flat at 36' behind cutting element 20. It is apparent, however, that cooling channels or slots 42 still effectively provide fluid to wear flat 40' via their outlets 44', and will continue to do so until cutting elements 20 are worn beyond utility.

Figure 2:
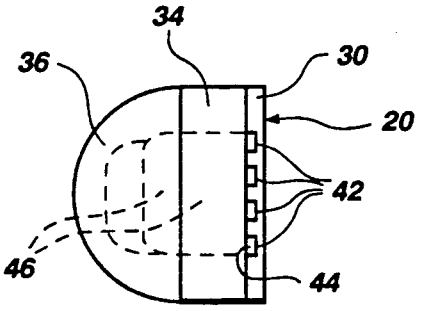
FIG. 2 is a top elevation of a second preferred embodiment of a cutting element according to the present invention.
Figure 3:
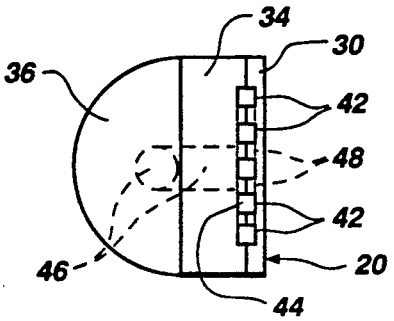
FIGS. 3 and 3A are, respectively, top and front elevations of a third preferred embodiment of a cutting element according to the present invention.

FIGS. 1A and 1B depict channels or slots 42 as residing wholly within substrate 34, but the invention is not so limited. For example, as shown by FIG. 2, the channels or slots 42 may reside within the diamond layer 30. Alternatively, channels or slots 42 may reside partially within substrate 34 and partially within diamond layer 30, as depicted by FIG. 3. Although not shown, it is also contemplated that the channels or slots 42 may be formed in or defined by a separate substrate sandwiched between substrate 34 and diamond layer 30.

It is very desirable to have significant contact between the flow of drilling fluid and the diamond layer or table of the cutting elements, so cutting elements in accordance with the present invention which maximize such contact, consistent with maintaining structural integrity of the cutting element, are preferred. This preferred design parameter is due to the high heat conductivity of diamond, which is far greater than that of other material typically employed in drill bits. Therefore, cooling diamond via cooling of another material, such as a WC substrate material interposed between the diamond and the cooling element, slot or port, does not take full advantage of the invention due to the heat transfer limitations of the intervening material. To obtain maximum heat transfer in general, a coolant should be in contact with the material to be cooled. To increase the film coefficient, or the rate at which heat may be transferred from the cutting element, the cooling fluid flow should be in contact with the diamond.

Figure 3A:
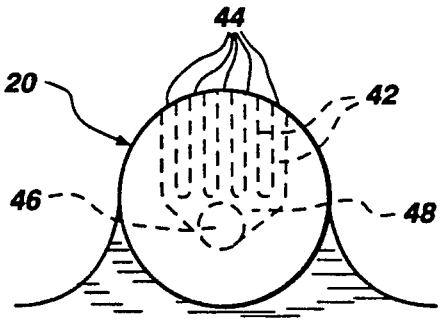

Passage 46 may extend directly to channels or slots 42 as depicted in FIGS. 1A, 1B and 2, or may feed a cross-channel or manifold 48 as shown in FIGS. 3 and 3A.

While the channels or slots 42 are depicted in FIGS. 1A and 1B as being oriented in mutually parallel relationship, it is also possible, and contemplated as within the scope of the invention, for them to be placed in non-parallel relationship such as by way of example, a fan-shaped pattern. Moreover, the channels or slots 42 may be of non-uniform cross section along their length, alternatively expanding or necking down toward outlets 44. Tapering or necking of the channels may be particularly efficacious during air drilling, wherein air or other gas is employed as the drilling fluid. The tapered or necked channels would then act as throttling elements, and the expanding gas exiting the outlets 44 would drop in temperature, providing additional cooling to the diamond table and substrate. Even using conventional liquid drilling mud, constrictions in the channels or slots 42 may be employed to meter the flow to the desired rate. Finally, channels or slots 42 and/or ports 44 may be of any desired cross section, such as square, rectangular, oval, round or half-circular, by way of example and not limitation.

Figure 4:
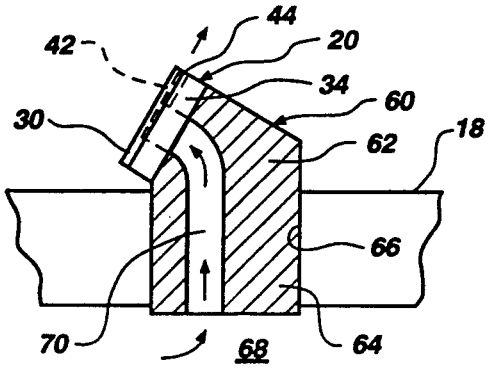
FIG. 4 is a side sectional view of a stud-type cutter employing a cutting element according to the present invention.

FIG. 4 depicts an embodiment of the present invention as incorporated in a so-called "stud" type cutter 60 which diamond layer 30 and substrate 34 of cutting element 20 are bonded to a cylindrical, rectangular, ellipsoidal or other cross-sectionally configured elongated stud 62, the lower end 64 of which is secured in an aperture 66 in the bit face 18 by means well-known in the art. Stud cutters may be employed with cast or machined steel body bits, and the apertures 66 formed therein by milling or drilling after casting. Stud cutters may also be utilized with cast matrix body bits. In either case, a plenum 68 in the bit body interior communicates with apertures 66, each stud 62 having an internal passage 70 for receiving drilling fluid from the plenum 68 and directing same (via a manifold or directly) to channels or slots 42 of cutting element 20 mounted on stud 62.

Figure 5:
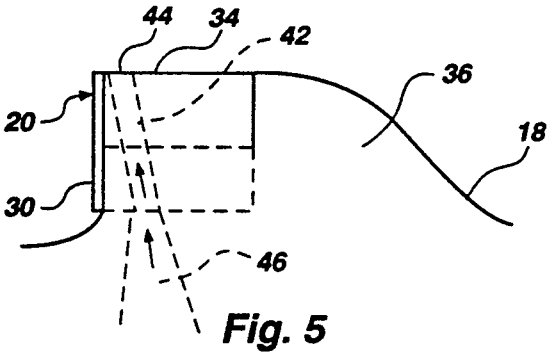
FIGS. 5 and 6 are side elevations of alternative embodiments of cutting elements according to the present invention.
Figure 6:
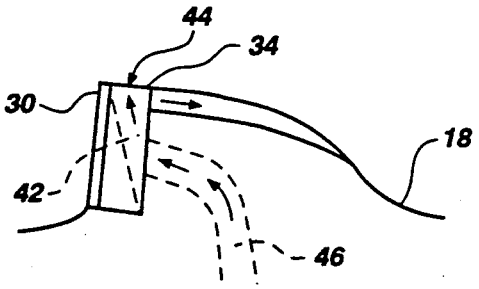

Although less preferred due to the decreased heat transfer between the diamond layer or table 30 and the drilling fluid, channels or slots 42 may reside entirely within substrate 34, as shown by FIGS. 5 and 6. It is also possible to direct fluid flow to the rear of a cutting element, as shown in FIG. 6, by extending some or all of slots 42 to the rear of cutting element 20 into the supporting matrix or stud.

Figure 7:
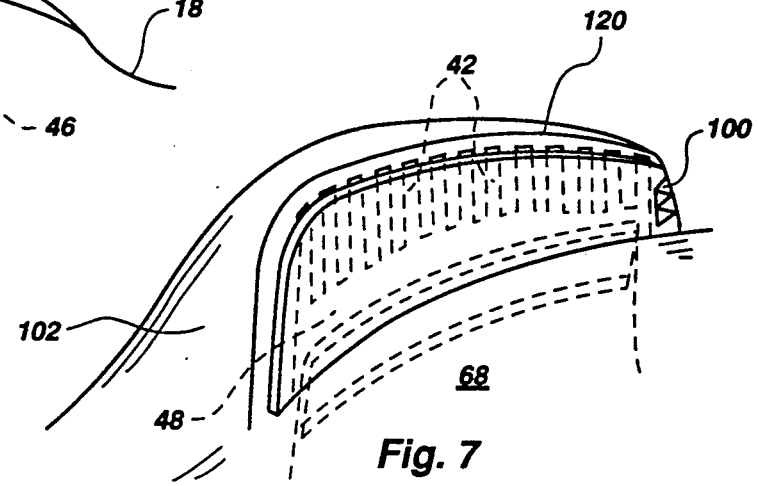
FIG. 7 is a perspective view of a blade type cutting element according to the present invention.

It is further anticipated that the present invention may be employed with blade-type bits, including those wherein the cutting face of the blade is formed of a plurality of small, laterally adjacent diamond elements 100 and heretofore referred to as a MOSAIC TM cutter. FIG. 7 is illustrative of such a blade 102 carrying cutting element 120, channels or slots 42 lying adjacent the rear edge of the layer of diamond elements 100 comprising cutting element 120, being fed from a manifold 48 which is in communication with bit plenum 68. It will be appreciated that such blade type bits may also employ cutting faces of sheets of diamond, diamond films, or conventional PDC cutting elements cooperatively configured for disposition in close proximity and formation of a single, large cutting surface.

In addition to the foregoing examples, the present invention may be utilized with a replaceable type cutter of the type illustrated in U.S. Pat. No. 4,877,096, assigned to the assignee of the present invention and hereby incorporated herein by this reference. In a replaceable cutter bit, the passage from the interior bit body plenum extends into the interior of the cutting element receptacle secured to the bit body, and communicates with a passage in the cutting element insert in the same manner previously described with respect to a stud cutter 60.

Figure 8:
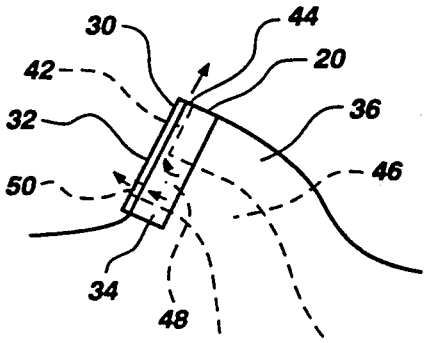
FIGS. 8 and 9 are side elevations of cutting elements according to the present invention including cutter face cleaning apertures of several configurations.
Figure 9:
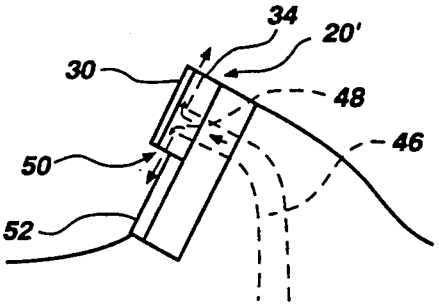

FIG. 8 depicted yet another alternative embodiment of the present invention, wherein a cleaning aperture 50 extends from manifold 48, opening onto the portion of the front 32 of cutting element 20 closest to the bit face, to enhance removal of formation cuttings from the cutting element 20 and to prevent adhesion of the cuttings thereto due to differential pressure. A similar arrangement can be employed with a "half-round" cutting element 20' as shown in FIG. 9, wherein the diamond layer 30 of cutting element 20' extends outwardly over a wear plate or substrate 52 of tungsten carbide, and a cleaning aperture or apertures 50 open downwardly over substrate 52 to enhance cuttings removal from cutting element 20'.

Figure 10:
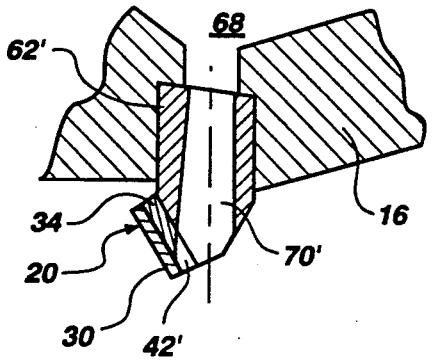
FIGS. 10, 11, 12 and 15 depict embodiments of the invention which employ elongated slots or grooves communicating with the rear of the cutting element substrate.
Figure 11:
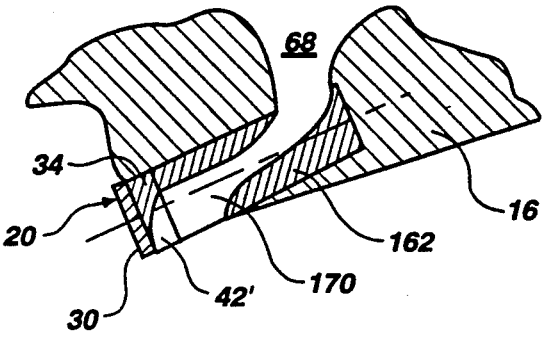
Figure 12:
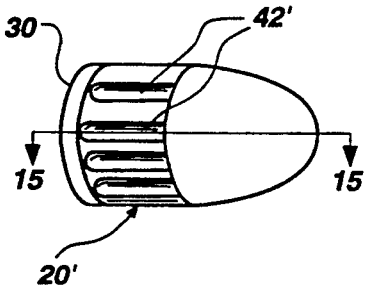
Figure 15:
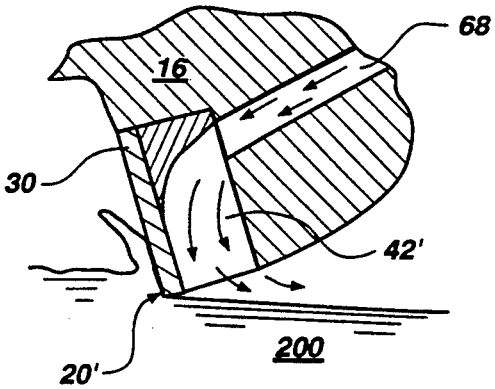

FIG. 10 is illustrative of a second type of stud cutter, wherein the internal passage 70' extends substantially along the axis of stud 62', and communicates with open channels or grooves 42' in substrate 34 of the cutting element 20'. A similar arrangement with a cutting element 20' affixed to a cylindrical carrier element 162 having an internal passage 170 is depicted in FIG. 11. FIGS. 12 and 15 depict an arrangement wherein bit plenum 68 communicates directly with slots or grooves 42' as cutting element 20' cuts formation 200.

Figure 13:
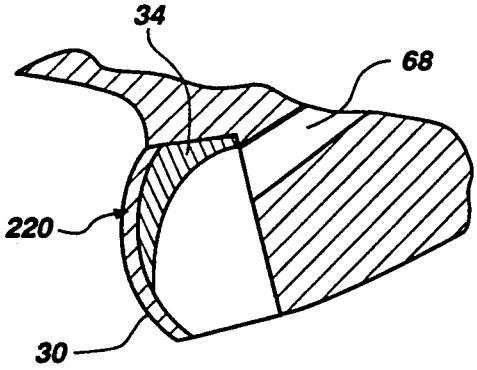
FIG. 13 depicts a cutting element according to the present invention having a convex cutting surface.

FIG. 13 depicts a non-planar type cutting element 220 in accordance with the invention having a convex or even dome-shaped diamond layer 30 disposed on a substrate 34. Such a structure may be effected by diamond film disposition techniques known in the art. It is also contemplated that the present invention may be employed with a concave diamond layer.

Figure 14:
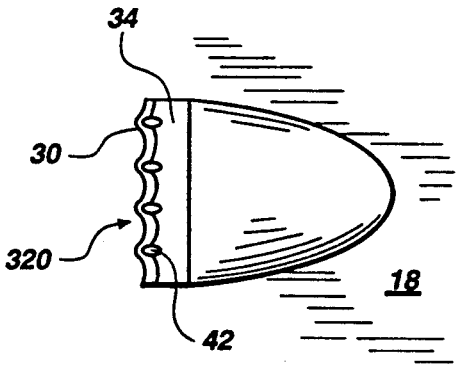
FIG. 14 depicts a cutting element according to the present invention employing an irregular, ridged diamond layer.

FIG. 14 depicts a bottom view (looking from the formation upward toward the bit in its operating orientation) of another non-planar cutting element 320 having a rippled or ridged configuration. Cutting element 320 includes ovoid channels 42 which extend into the ridged portion of diamond layer 30 for greater fluid contact area.

Finally, it is contemplated that the invention may be employed with diamond layers of non-uniform thickness or even non-uniform composition.

It will be appreciated by those of ordinary skill in the art that many additions, deletions and modifications to the preferred embodiments as disclosed herein are possible without departing from the scope of the claimed invention. For example, a half-round cutting element may be employed with a stud cutter, cleaning apertures might be incorporated in the cutting face of a blade type bit, and others.

What is claimed is:

1. A diamond cutting element for boring a subterranean formation, comprising:

a diamond layer including a front face and a rear face;

substrate means secured to said rear face;

a peripheral contact zone on said diamond layer for engaging said subterranean formation; and at least one internal channel including an outlet proximate said peripheral contact zone, said at least one internal channel extending along the boundary between said rear face and said substrate means as said channel approaches said outlet.

2. The diamond cutting element of claim 1, further including a feed passage for providing fluid to said at least one internal channel.

3. The diamond cutting element of claim 1, wherein said at least one channel is disposed at least partially in said diamond layer.

4. The diamond cutting element of claim 1, wherein said at least one channel is disposed at least partially in said substrate means.

5. The diamond cutting element of claim 1, wherein said at least one channel is defined at least in part between said diamond layer and said substrate means.

6. The diamond cutting element of claim 1, wherein said at least one channel comprises a plurality of channels having outlets disposed along said peripheral contact zone, and further including at least one cross-channel extending between at least two of said channels.

7. The diamond cutting element of claim 6, wherein said at least one cross-channel communicates with all of said channels.

8. The diamond cutting element of claim 1, wherein said at least one channel comprises a plurality of channels having outlets disposed along said peripheral contact zone and disposed in substantially mutually parallel relationship as they approach said outlets.

9. The diamond cutting element of claim 1, wherein said at least one channel comprises a plurality of channels having outlets disposed along said peripheral contact zone and diverging as they approach said outlets.

10. The diamond cutting element of claim 1, wherein said at least one channel comprises a plurality of channels extending from a common plenum means.

11. The diamond cutting element of claim 1, further including a cleaning aperture in addition to said at least one channel outlet extending from the interior of said cutting element to said front face.

12. The diamond cutting element of claim 1, further including a cleaning aperture extending from the interior of said cutting element to a location remote from said peripheral contact zone and adjacent said front face.

13. The diamond cutting element of claim 1, wherein said at least one channel contacts said rear face and extends through the rear of said substrate means.

14. The diamond cutting element of claim 1, wherein said diamond layer is substantially planar.

15. The diamond cutting element of claim 1, wherein said diamond layer is arcuate.

16. The diamond cutting element of claim 1, wherein said diamond layer is ridged.

17. The diamond cutting element of claim 1, wherein said diamond layer is of non-uniform thickness.

18. An earth boring drill bit, comprising:

a bit body including a face;

at least one diamond cutting element having a peripheral cutting edge and disposed on said bit face;

an internal fluid passage in said bit body leading to said at least one diamond cutting element;

a plurality of channels in said diamond cutting element in communication with said internal fluid passage and having outlets disposed along said peripheral cutting edge.

19. The earth boring drill bit of claim 18, wherein said at least one diamond cutting element comprises a diamond layer having a front face and a rear face, and a non-diamond substrate secured to said rear face.

20. The earth boring drill bit of claim 19, wherein said channels are defined in said substrate.

21. The earth boring drill bit of claim 19, wherein said channels are defined in said diamond layer.

22. The earth boring drill bit of claim 18, wherein said channels are defined partially in said diamond layer and partially in said substrate.

23. The earth boring drill bit of claim 18 wherein said channels are defined between said diamond layer and said substrate.

24. The earth boring drill bit of claim 18, wherein said substrate includes an aperture therein for communicating said channels with said fluid passage.

25. The earth boring drill bit of claim 18, further including a plenum extending to all of said channels.

26. The earth boring drill bit of claim 19, further including a cleaning aperture in communication with said internal fluid passage extending from the interior of said cutting element through said front face at a location remote from said peripheral cutting edge.

27. The earth boring drill bit of claim 19, further including a cleaning aperture in communication with said internal fluid passage extending from the interior of said cutting element to a location remote from said peripheral cutting edge and adjacent said front face.

28. A method of cooling a diamond cutting element on an earth boring drill bit, comprising:

providing a diamond cutting element having a peripheral cutting edge;

contacting the earth with said peripheral cutting edge; and providing a flow of cooling fluid through said cutting element to said peripheral cutting edge at a plurality of locations along said peripheral cutting edge.

29. The method of claim 28, wherein said cooling fluid is provided to said peripheral cutting edge at a plurality of laterally adjacent locations.

30. The method of claim 28, wherein said diamond cutting element comprises a diamond layer affixed to a substrate, and further including the step of providing a flow of cooling fluid along the boundary zone between said diamond layer and said substrate.

31. A diamond cutting element for boring a subterranean formation, comprising:

a diamond layer disposed on a substrate;

at least one internal channel extending through said cutting element to the periphery thereof, said at least one internal channel extending at least in part along the boundary zone between said diamond layer and said substrate.

* * * * *

UNITED STATES PATENT AND TRADEMARK OFFICE

CERTIFICATE OF CORRECTION

PATENT NO. 5,316,095

DATED May 31, 1994

INVENTOR(S) Gordon A. Tibbitts

It is certified that error appears in the above-indentified patent and that said Letters Patent is hereby corrected as shown below:

In Column 1, line 22, insert a period after "employed";

In Column 2, line 26, underline "through";

In Column 9, line 11, change "18" to --19--;

In Column 9, line 14, change "18" to --19--;

In Column 9, line 17, change "18" to --19--.

Signed and Sealed this

Eighth Day of November, 1994

Bruce Lehman

*Attest:*

BRUCE LEHMAN

*Attesting Officer*

*Commissioner of Patents and Trademarks*